US006439830B2

(12) United States Patent
Satorius et al.

(10) Patent No.: US 6,439,830 B2
(45) Date of Patent: Aug. 27, 2002

(54) OPENING GUARD MECHANISM FOR PRINTED PRODUCT STACKING DEVICE

(75) Inventors: Robert Satorius, Cleveland; Mark Thompson, Lorain; Michael McGeady, Columbia Station, all of OH (US)

(73) Assignee: Total Mailroom Support, Inc., Middleburg Heights, OH (US)

( * ) Notice: Subject to any disclaimer, the term of this patent is extended or adjusted under 35 U.S.C. 154(b) by 18 days.

(21) Appl. No.: 09/733,258

(22) Filed: Dec. 8, 2000

Related U.S. Application Data

(60) Provisional application No. 60/169,555, filed on Dec. 8, 1999.

(51) Int. Cl.[7] ..... B65G 57/06

(52) U.S. Cl. ..... 414/790.3; 414/791.2

(58) Field of Search ..... 198/860.3, 860.4, 198/860.5; 414/790.3, 791.2, 791.3

(56) References Cited

U.S. PATENT DOCUMENTS

| | | | | |
|---|---|---|---|---|
| 1,703,466 A | | 2/1929 | Wright | |
| 3,595,370 A | | 7/1971 | Fujishiro | |
| 3,599,807 A | | 8/1971 | Hedrick et al. | |
| 3,902,609 A | | 9/1975 | Ohlsson | |
| 4,068,567 A | | 1/1978 | Allison et al. | |
| 4,103,785 A | | 8/1978 | Wiseman | 198/374 X |
| 4,457,656 A | | 7/1984 | Kosina et al. | |
| 4,720,229 A | | 1/1988 | Steinhart | 198/468.11 X |
| 4,812,099 A | | 3/1989 | Sjogren et al. | 414/788.2 |
| 5,392,700 A | * | 2/1995 | Kleinhen | 414/791.2 X |
| 5,559,664 A | * | 9/1996 | Dogul et al. | 361/191 |
| 5,842,827 A | | 12/1998 | Kwasniewski et al. | 414/802 |
| 5,868,548 A | | 2/1999 | Merwarth | 414/790.3 |
| 5,880,954 A | * | 3/1999 | Thomson et al. | 364/184 |
| 6,109,475 A | * | 8/2000 | Graham | 198/860.4 X |
| 6,120,239 A | * | 9/2000 | Roskam | 414/791.2 |
| 2001/0031197 A1 | * | 10/2001 | Jager | 414/789.9 |

FOREIGN PATENT DOCUMENTS

WO WO 98/47645 * 10/1998

OTHER PUBLICATIONS

"Theory of Operation and Terminology: How Safety Light Curtains Work," Scientific Technologies, Inc., Fremont, CA. Applicants' written submission.

* cited by examiner

*Primary Examiner*—Janice L. Krizek
(74) *Attorney, Agent, or Firm*—Fay, Sharpe, Fagan, Minnich & McKee, LLP

(57) ABSTRACT

Newspapers and other printed matter fed from a printing press or inserting machine are generally folded or delivered in a continuous stream with the papers oriented in an overlapped or imbricated relationship. The stream of papers are received and stacked by the stacking apparatus or stacker which must operate at high speeds. The stacker orients the papers in the stacks and ejects the bundles of papers. The present invention relates to devices intended to reduce the prospects for inadvertent interference with the stacking mechanism or to reduce the potential for injury.

10 Claims, 7 Drawing Sheets

OPENING GUARD MECHANISM FOR PRINTED PRODUCT STACKING DEVICE

This application claims priority from Provisional application U.S. Ser. No. 60/169,555, filed Dec. 8, 1999.

BACKGROUND OF THE INVENTION

1. Field of the Invention

The present invention relates to the field of article stacking devices, and more particularly to stacking devices for assembling a stream of printed products into stacks or bundles and ejecting the stacks of printed products. Specifically, the present invention relates to devices intended to reduce the prospects for inadvertent interference with the stacking mechanism or to reduce the potential for injury.

2. Discussion of the Art

Newspapers and other printed matter fed from a printing press or inserting machine are generally folded or delivered in a continuous stream with the papers oriented in an overlapped or imbricated relationship. The stream of papers are received and stacked by the stacking apparatus or stacker which must operate at high speeds. The stacker orients the papers in the stacks and ejects the bundles of papers in at least two directions at a rate which exceeds one stack ejected per second.

Stackers generally operate by moving a fork into the continuous stream of papers to collect a desired number of papers which form a portion of the bundle. Forks are generally spring-mounted to a chain drive which rotates to continually receive and deliver batches of papers to a bucket or stacking section of the stacker. After a predetermined count of papers are received on a fork, a next fork intercepts the paper stream and begins collecting papers for the next batch. The forks move downward as the papers are collected and drop the completed batches onto a turntable which collects the papers in a stack.

Since newspapers and other printed materials generally have a thickness which is greater along the folded side of the paper than on the unfolded side of the paper, two or more batches are generally stacked on the turntable with the folded edges of the successive batches rotated 180° to form a bundle. This provides a more even stacking of the papers. In order to form the bundle with the alternately rotated batches, the stacking platform or turntable is driven by a heavy-duty motor which rotates the turntable 180° between receiving successive batches from the forks.

Once a predetermined bundle size is reached, the bundle is ejected from the stacker by, for example, pushing the bundle off the turntable with a pusher bar. Thus, the bucket area or stacking region where the bundles are formed on the turntable is a complex mechanical region where a number of moving components are operating very rapidly to keep up with the demands of the printing press. For example, printed products are dropped from overhead. The turntable undergoes periodic rotation. The bundle eject mechanism is periodically operated to remove the bundle from the turntable. Accordingly, this region has been maintained at least partially open to allow access to the various components and provide ease of maintenance access. However, in an effort to preclude interference with this complex mechanical operation, and also to reduce the possibility for potential injury, improvements to the stacker are desired.

DETAILED DESCRIPTION OF THE INVENTION

Figure 1:
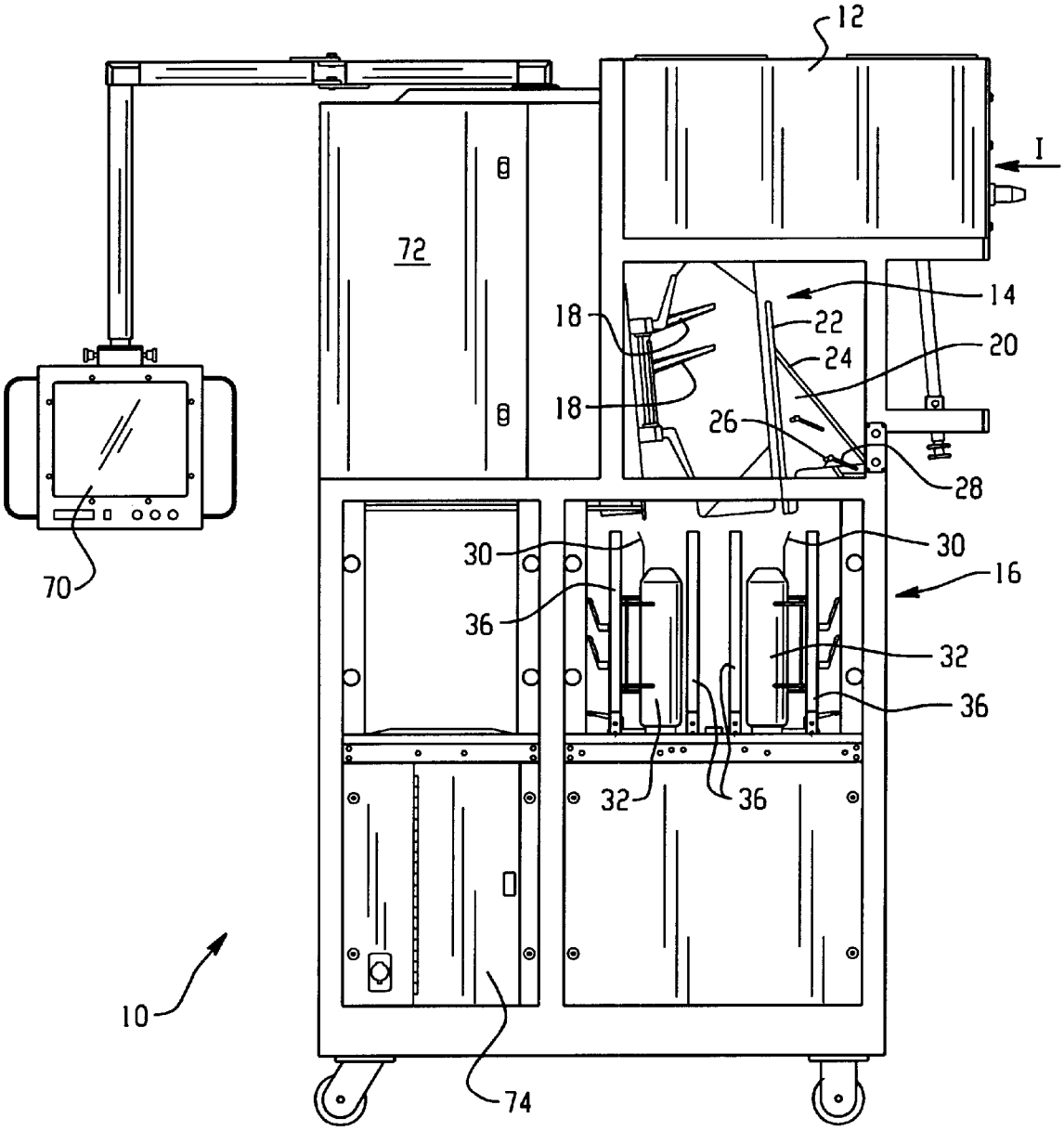
Fig. 1 PRIOR ART
FIG. 1 is an elevational view of a conventional stacker.

Referring now to the drawings wherein the showings are for purposes of illustrating the preferred embodiment of the invention only and not for purposes of limiting same, the FIGURES show a stacking apparatus 10 including an infeed assembly 12 for receiving an input stream of folded overlapping printed products or papers, a stacking section 14 for forming the papers into batches, and a turntable assembly 16 for receiving the batches in a stack or bundle and ejecting the bundles in two opposite directions. The stacker is described herein for use in stacking newspapers or papers, however, it should be understood that the stacker is intended for stacking any substantially flat articles including both printed and unprinted materials.

Figure 2:
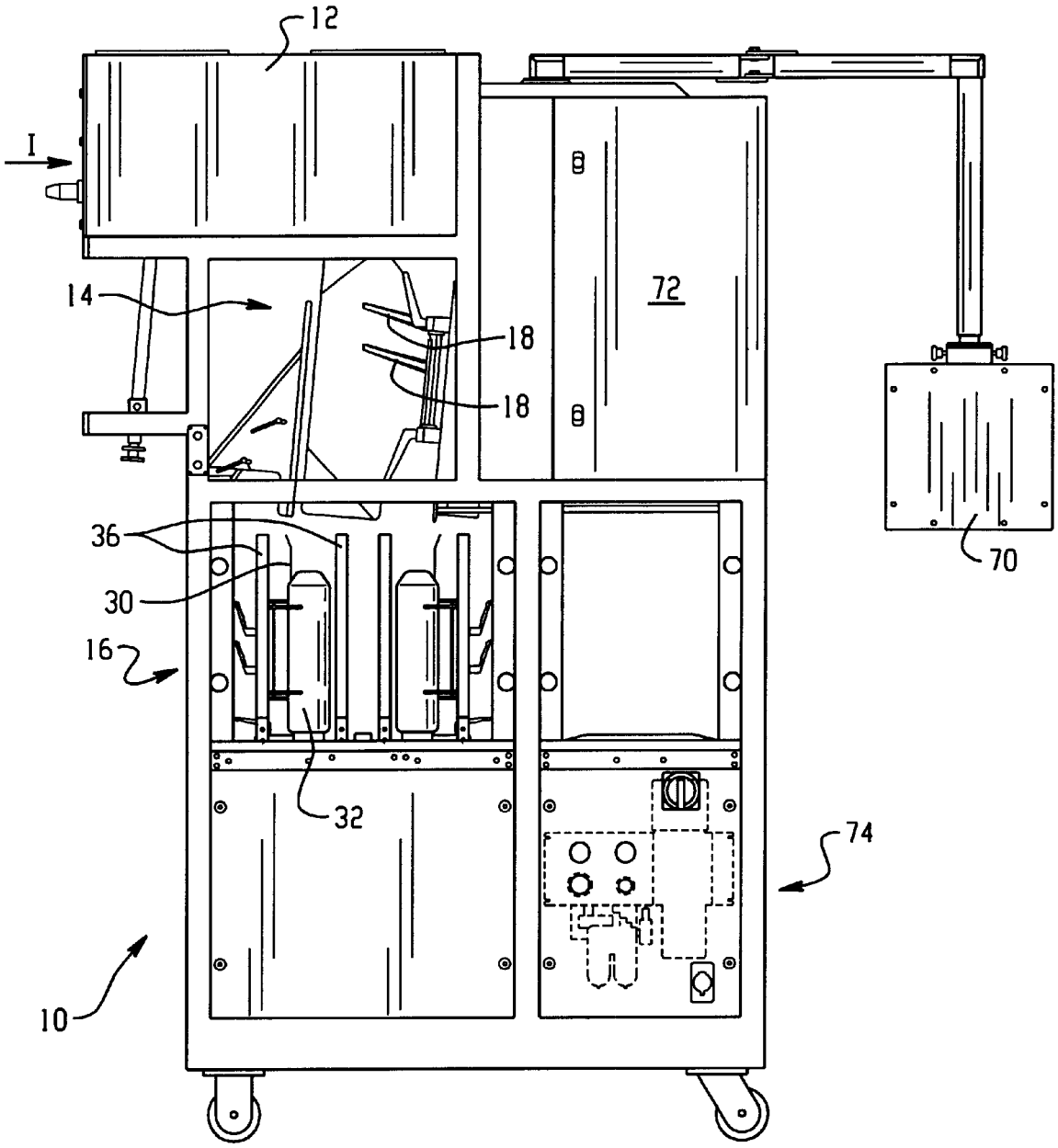
Fig. 2 PRIOR ART
FIG. 2 is an enlarged view of the stacker with selected panels removed to illustrate the internal components of the assembly.

With respect to FIGS. 1 and 2, papers exiting a printing press are fed into the stacker 10 in an infeed direction illustrated by the arrow I between an upper conveyor and lower conveyor of the infeed assembly 12. The papers are preferably fed with their folded side passing initially into the stacking apparatus and with the folded edges of each of the papers overlapping a previous page. The papers are delivered by conveyors in the infeed assembly 12 to the stacking section 14.

The stacking section 14 includes a plurality of forks 18 which are formed of a pair of claws mounted at fixed distances apart along a pair of closed loop drive chains. These forks 18 each receive and support a batch of papers which drop onto the forks from the infeed assembly 12. Various mechanical and/or optical sensors may be used in connection with the stacking section 14 to count a number of papers in each batch and to control the movement of the forks 18 to obtain a desired number of papers in each batch. The forks 18 are spring loaded to intercept the continuous stream of papers. The stacking section 14 also includes a guide device 20 which guides the trailing edges of the papers as the papers pass onto the forks 18. The guide device 20 includes a substantially planar guiding surface 22 and a support member 24. The support member 24 includes slots 26 receiving locking members 28 which allow the position of the guide device 20 to be adjusted to accommodate papers of different sizes.

As the forks 18 move downward and reach a bottom of the closed loop drive chains, the forks rotate causing the batch of papers to be released or dropped into the turntable assembly 16. The turntable assembly 16 includes guide members 30 for supporting the stack of papers on two opposite sides, and end guide members 32 for supporting the stack on the two opposite sides. The guide members 30, 32 taper outward at their top edges to receive the papers. The end guide members 32 pivot open and closed to allow the stacks of papers to be ejected from the turntable assembly when the end guide members are in an open position.

As a batch of papers is delivered to the turntable assembly 16 by the stacking section 14, often the stack will be higher on the one side than the other due to the thickness of the fold or spine of the paper. In order to achieve a bundle having an even height, the turntable assembly 16 is rotated 180° between delivery of successive batches of papers. It is also possible to rotate the turntable assembly 90° between delivery of batches when a stack of square papers is being formed. However, in general, stacked papers are not square, thus a 180° rotation is used.

The stacking apparatus 10 of FIGS. 1 and 2 also includes an operator station 70 for operator control of the stacking apparatus, an electrical and power supply panel 72 for controlling the coordination of the various functions of the stacker, and a pneumatic control assembly 74 for controlling the various pneumatic devices of the stacker. These control elements may be of any of those control elements which are known to those in the art.

Figure 3:
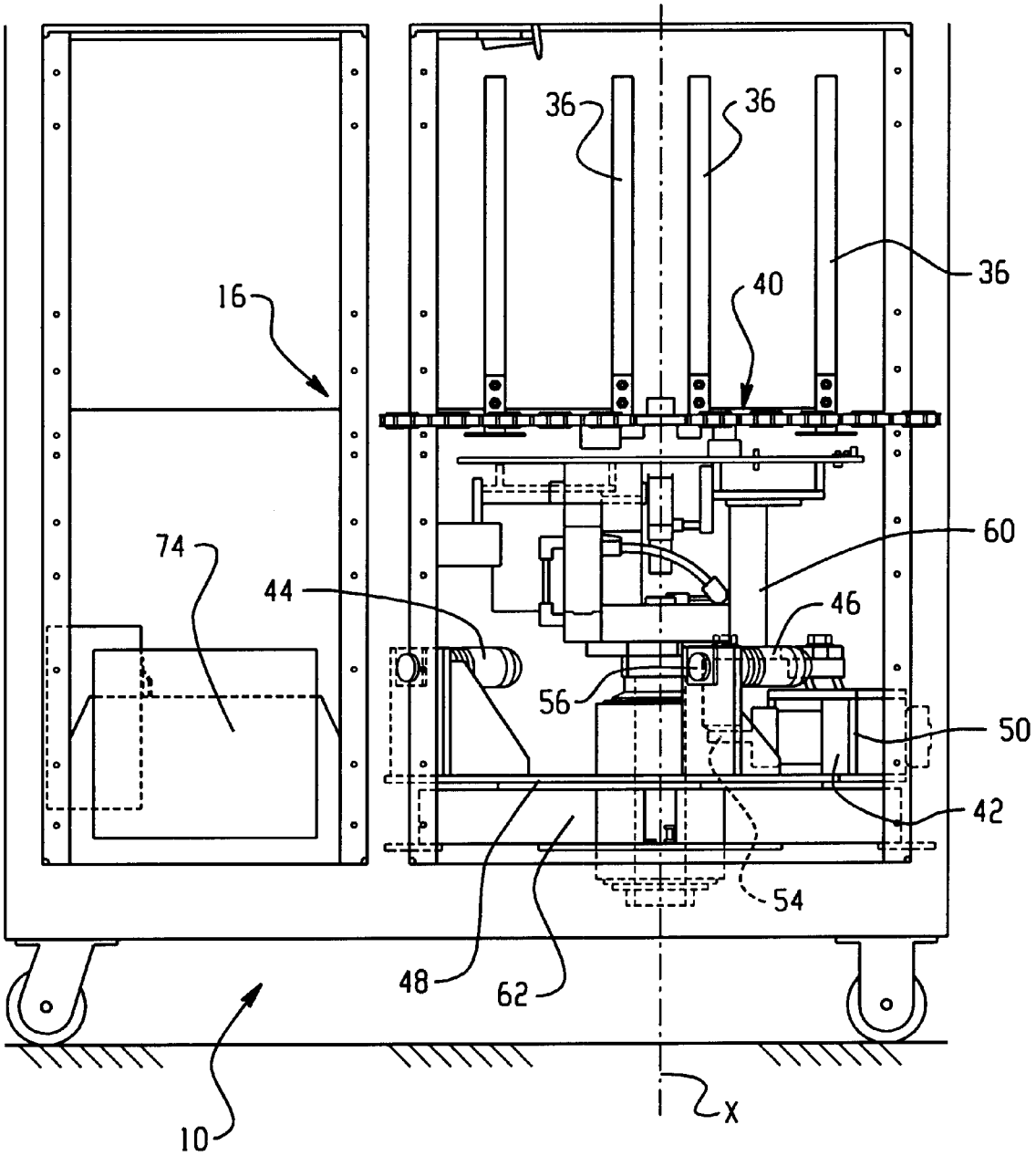
Fig. 3 PRIOR ART
FIG. 3 is an enlarged left side view of the lower half of the stacker in which the lower panel has been removed to expose the turntable assembly.

FIG. 3 is a side view of a lower portion of the stacking apparatus 10 with the lower side panel removed to expose a lower portion of the turntable assembly 16 and a drive assembly for rotating the turntable assembly back and forth 180°. The drive assembly includes an air operated cylinder 42 or motor for rotating the turntable and two shocks 44, 46 for stopping the turntable rotation. A motor for rotating the turntable is preferably the pneumatic cylinder 42, however, other types of motors may also be used. The cylinder 42 is pivotally attached on a base plate 48 by a cylinder pivot frame assembly 50. A piston rod 52 of the cylinder 42 is pivotally attached to a portion of the rotatable turntable 60 by a cylinder stud 54 at a point which is displaced from an axis of rotation X of the turntable 40. The pneumatic cylinder 42 or motor operates to rotate the turntable 40 back and forth through 180° of rotation.

The shocks 44 and 46 halt the motion of the turntable 40 more quickly than the cylinder 42 alone and allow the cylinder to rotate the turntable at a speed which is higher than the speeds currently used in stacking devices without shocks. The shocks 44, 46 stop the rotation of the turntable 40 by engaging one of two pads 56 mounted on the turntable frame 60. The shocks 44, 46 are preferably heavy duty shocks.

Figure 4:
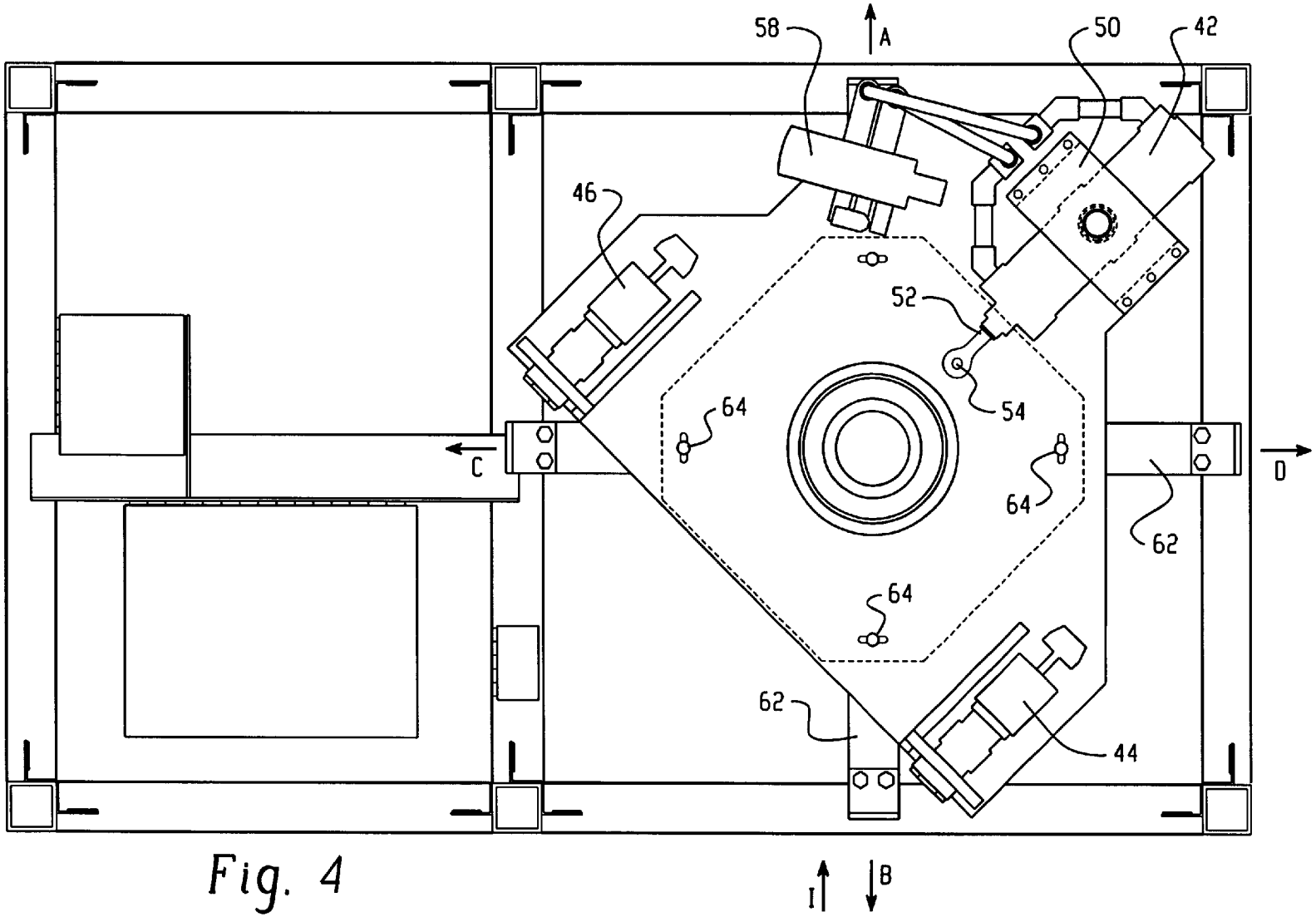
Fig. 4 PRIOR ART
FIG. 4 is a top view of the motor drive assembly for driving the turntable without the rotatable turntable or turntable assembly.

The pneumatic cylinder 42 and pivot frame 50 supporting the cylinder, as well as the shocks 44, 46 are best illustrated in the top view of FIG. 4, in which the turntable assembly has been omitted for clarity. The turntable 40, the cylinder 42, and the shocks 44, 46 are mounted on the base plate 48 along with a pneumatic control valve assembly 58 for controlling the pneumatic cylinder. This base plate 48 is rotatable on the base frame 62 of the stacking apparatus to allow the turntable assembly to be rotated to two different positions or orientations to eject bundles in different directions. The base plate 48 is rotated by removing the four bolts 64 which secure the base plate the base frame 62 and rotating the base plate 48 about a central bearing to a new position where the bolts are then resecured.

By allowing the rotation of the entire turntable 40, motor or cylinder 42, as well as the shocks 44, 46, the stacker can advantageously eject stacks either in the two opposite directions A and B which are parallel to an infeed direction I of the stacker or may eject stacks in the two opposition directions C and D which are normal to the infeed direction I, or it is contemplated that the stacker could even eject stacks in any of the four directions. During normal operation, however, the bundles are typically ejected in one direction and if a malfunction occurs downstream then the bundles are ejected in another direction until the malfunction is overcome.

The description of FIGS. 1–4 represents one commercially available stacker. It will be appreciated, however, that other stackers are constructed and operate in a similar manner.

Figure 5:
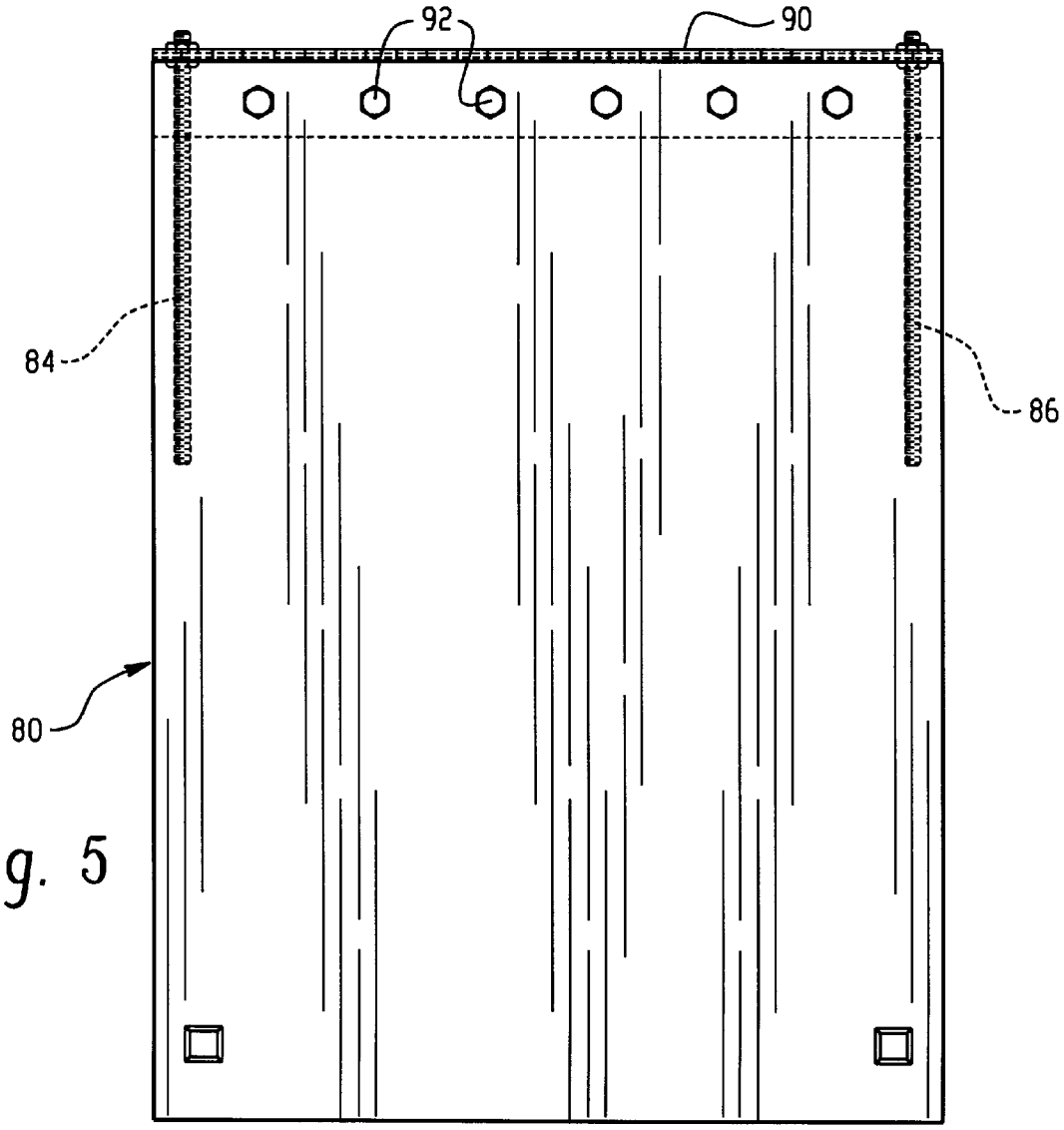
FIG. 5 is an elevational view of a stacker discharge guard assembly.

FIG. 5 illustrates a door mechanism or opening guard for a stacker illustrated in a first preferred embodiment as a generally rectangular panel 80 which is adapted to be secured to the frame of the stacker. The panel is dimensioned to substantially cover an opening through which the bundles are ejected from the turntable. This opening is represented by numeral 82 in FIGS. 1 and 3. It will be appreciated that the panel is secured to the frame via any suitable fastener arrangement, such as the elongated fastener rods 84, 86. A hinge 90 is preferably disposed at one end of the panel and interconnects the panel to the threaded rods, i.e., the stacker frame. A series of fasteners 92 are spaced along one edge of the panel to secure the hinge thereto. In those stackers which discharge bundles in two directions, for example 180° apart, one of the openings is typically in operation and only if a malfunction occurs, is the second discharge opening required. Thus, for example, the second opening is only occasionally used and is conventionally left open to the work environment so as not to impede the opening should it become necessary to discharge bundles therethrough. Consequently, this second opening is the type of situation where the above described hinged panel would be ideally used. If additional discharge openings are provided from the stacker, then additional guards are required.

It will be appreciated that the hinge is intended to be a one-way hinge. Stated another way, the hinge will pivot outwardly away from the turntable to permit a stacked bundle to exit from the turntable to, for example, a downstream conveyor. It will preclude movement in the opposite direction, i.e., it will prevent entry of materials inwardly toward the turntable.

The guard assembly is intended to be part of the original manufacture of a stacker or an aftermarket addition to stackers already in commercial use. Although the dimensions of the frame openings of other stackers may vary, the concept of a panel hingedly secured to the frame to cover the less frequently used discharge openings can be easily accommodated in other stackers without departing from the scope and intent of the present invention.

Figure 6:
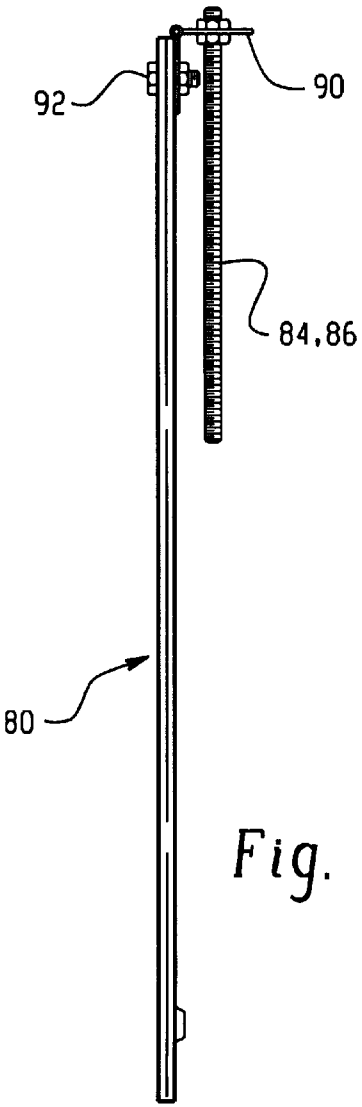
FIG. 6 is an elevational view taken generally from the right-hand end of FIG. 5.
Figure 8:
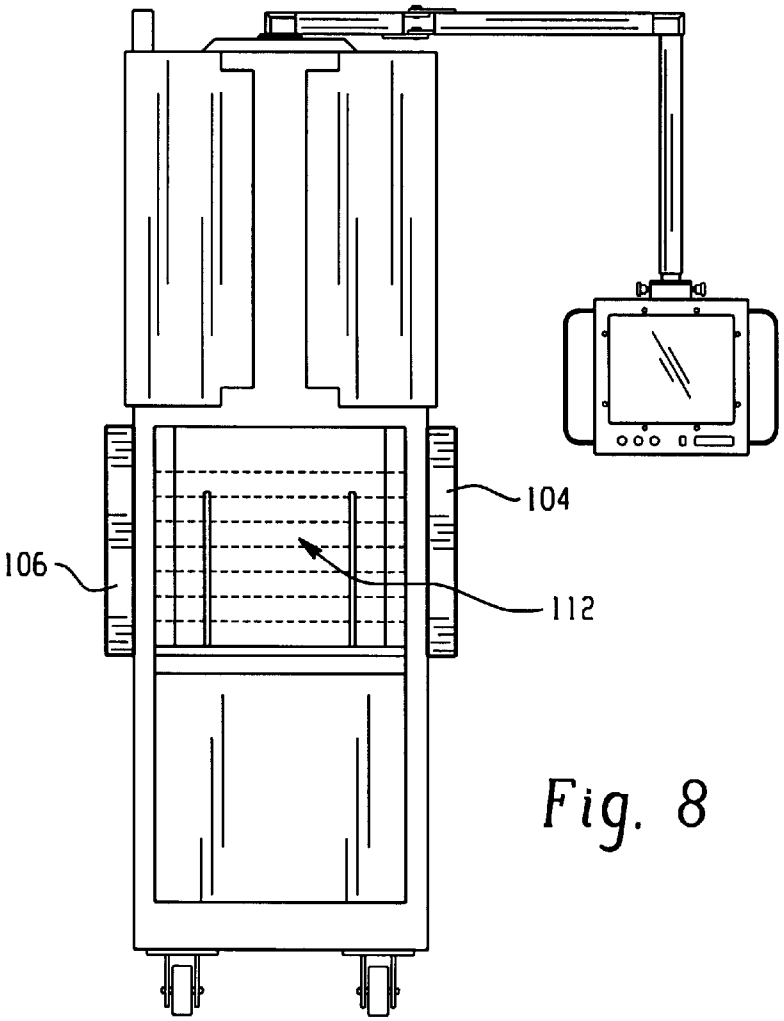
FIG. 8 is an elevational view taken generally from the right-hand end of FIG. 7.
Figure 7:
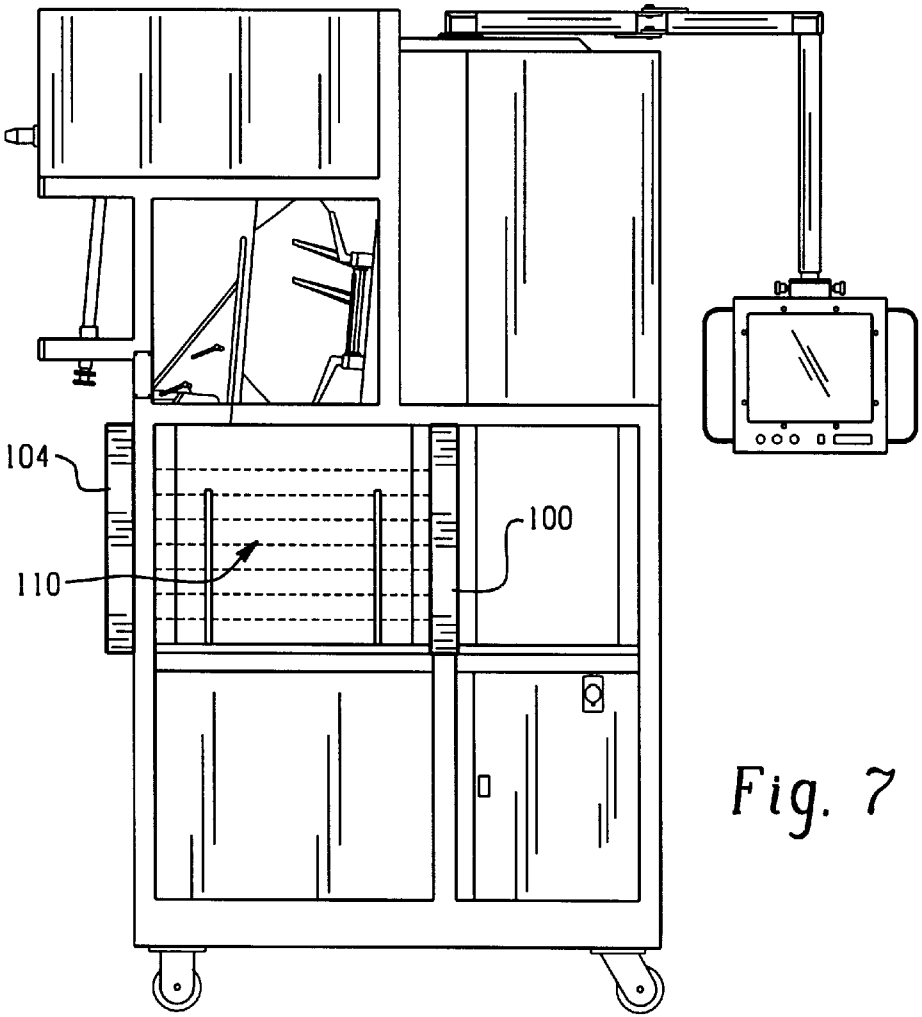
FIG. 7 is an elevational view of an alternative stacker discharge guard assembly.
Figure 9:
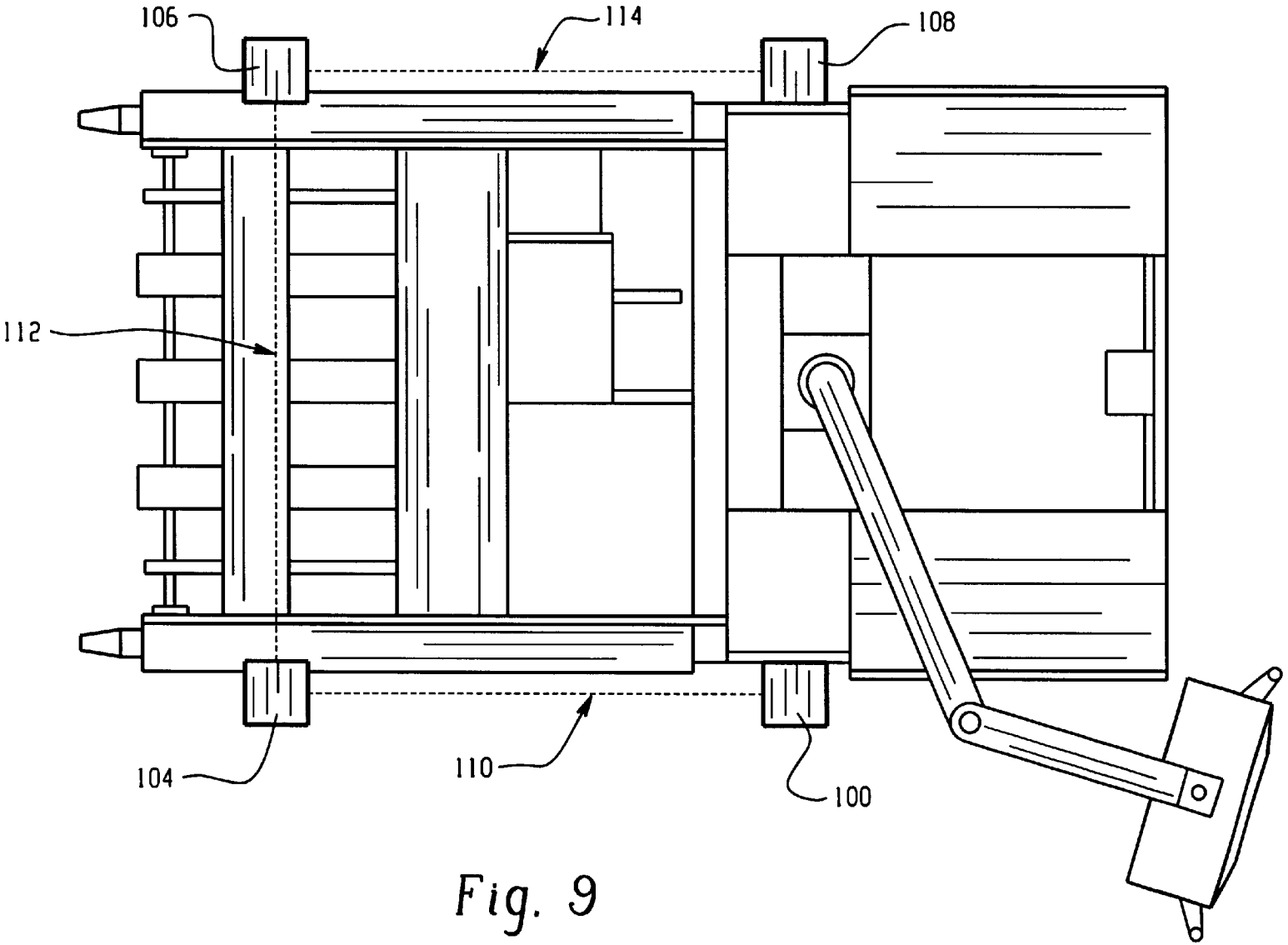
FIG. 9 is an overhead plan view of the stacker of FIG. 7.

A second preferred embodiment of an opening guard for a stacker is illustrated in FIGS. 7–9. Again, a conventional stacker is illustrated that has a pair of discharge openings permitting the bundles to be ejected from the turntable in directions oriented 180° relative to one another. There is some consideration that a panel as described above in conjunction with the embodiment of FIGS. 5 and 6 could adversely impact on the bundle. That is, the bundle has not yet been tied as it leaves the stacker. Accordingly, the bundle is subject to impact with the panel and, depending upon the force imposed by the hinge, there is the potential that some of the printed product could be dislodged or skewed from the bundle. A non-contact sensor is illustrated in the embodiment of FIGS. 7–9. It establishes a sensor field over the area of each opening, that, if broken, will send a suitable signal to control operation of the stacker.

More particularly, a transmitter column 100 is secured to the stacker frame. It employs a sensor or series of individual sensors arrayed, for example, in a vertical array to emit a signal or array of signals to a reflective transfer column 104. The intensity, spectrum, modulation, sequencing, etc. of the signal can be selected from a number of parameters, as well as the control unit that supports the power, diagnostics, transmitter, transfer, receiver, redundant operations, etc. without departing from the scope and intent of the present invention. The transfer column is preferably a reflective surface such as a stainless steel or mirrored surface that re-directs the sensing field to a second column 106. Column 106 is essentially identical in structure to column 104. It, too, redirects the sensing field to a receiving column 108. Thus, in this preferred arrangement, three sensing fields 110, 112, 114 are established and are oriented generally 90° to the contiguous field. In this manner, the sensing field between columns 100, 104 and columns 106, 108 establishes a non-contact stacker discharge guard assembly over the discharge openings. Likewise, if bundles are to be discharged in the region between the columns 104, 106, then a non-contact guard is established along that plane also. Thus, it will be understood that a greater or lesser number of discharge openings is contemplated by either adding to or subtracting the number of columns 104, 106 from the assembly. For example, a closed-loop arrangement could be used where the transmitter and the receiver columns abut one another and outline a peripheral, polygon arrangement where the signal is transmitted or forwarded via the reflective columns to a next adjacent column.

If a bundle is scheduled for ejection from the bucket region, then breaking the field in the particular discharge opening will not interrupt the operation of the stacker. On the other hand, if one of the other fields is interrupted or broken, then operation of the turntable ejection mechanism may be immediately interrupted.

The controller that regulates operation of the stacker can be programmed to immediately cease further operation of the stacker if one or more of the fields is broken. It is also contemplated that if the stacker is undergoing an ejection cycle, then the controller would permit the bundle ejection cycle to be completed before the stacker operation (or at least the turntable operation) is terminated.

The invention has been described with respect to the preferred embodiments. Modifications and alterations will become apparent to others upon reading and understanding the specification. These modifications and alterations are also contemplated as being a part of the present invention without being expressly stated herein.

Having thus described the invention, we claim:

1. A stacking apparatus for assembling a stream of printed products, said stacking apparatus comprising:

a frame having at least one opening through which a bundle is selectively ejected;

a table assembly;

a bundle ejection mechanism that selectively ejects a bundle of printed products from said table assembly; and, at least one guard assembly operatively associated with the at least one frame opening, wherein said at least one guard assembly is comprised of at least one non-contact sensor assembly operatively associated with the at least one frame opening and wherein the at least one sensor assembly is operatively associated with a stacking apparatus controller which terminates operation of the table assembly in response to detecting foreign object ingress through the at least one frame opening.

2. A stacking apparatus for assembling a stream of printed products, said stacking apparatus comprising:

a frame having at least one opening through which a bundle is selectively ejected;

a table assembly;

a bundle ejection mechanism that selectively ejects a bundle of printed products from said table assembly; and, at least one guard assembly operatively associated with the at least one frame opening, wherein said at least one guard assembly is comprised of at least one non-contact sensor assembly operatively associated with the at least one frame opening and wherein the at least one sensor assembly is operatively associated with a stacking apparatus controller which, unless a bundle discharge ejection is in process, terminates operation of the table assembly in response to detecting foreign object ingress through the at least one frame opening.

3. A stacking apparatus for assembling a stream of printed products, said stacking apparatus comprising:

a frame having at least one opening through which a bundle is selectively ejected;

a table assembly;

a bundle ejection mechanism that selectively ejects a bundle of printed products from said table assembly; and, at least one guard assembly operatively associated with the at least one frame opening, wherein said at least one guard assembly is comprised of at least one non-contact sensor assembly operatively associated with the at least one frame opening and wherein the at least one sensor assembly is operatively associated with a stacking apparatus controller which alters operation of the stacking apparatus in response to detecting foreign object ingress through the at least one frame opening.

4. The stacking apparatus according to claim 3, wherein a sensor field is established over the frame opening by a transmitter and a receiver.

5. The stacking apparatus according to claim 4, wherein said sensor field is a signal array, formed by a transmitter column and at least one receiver column, said signal array uniformly distributed across the at least one frame opening and detecting foreign object ingress through said frame opening.

6. The stacking apparatus according to claim 5, wherein said sensor field signal array is forwarded via one reflective transfer column to a second reflective transfer column in a second frame opening and terminates at the receiver column.

7. A stacking apparatus for assembling a stream of printed products into bundles comprising:

a frame having a discharge opening dimensioned to allow a bundle to pass therethrough;

a turntable assembly;

a drive assembly reciprocating and rotating said turntable assembly, and selectively ejecting a bundle from the turntable assembly; and a guard assembly operatively associated with the discharge opening, wherein said guard assembly is comprised of a non-contact sensor assembly, the sensor assembly establishes a sensor field over the discharge opening by a transmitter column and a receiver column, and wherein the sensor field is an array of signals, formed by the transmitter column and the receiver column, said and the receiver column, said column distributing the signal across the discharge opening and preventing foreign object ingress thereto.

8. The stacking apparatus of claim 7, wherein said sensor field signal array is forwarded via a reflective transfer column, to a second reflective transfer column in a second discharge opening and terminates at the receiver column.

9. The stacking apparatus of claim 7, wherein interrupting said sensor field array of signals terminates operation of said stacking apparatus.

10. The stacking apparatus of claim 7, wherein interrupting said sensor terminates operation of said stacking apparatus after the bundle ejecting cycle is complete.

* * * * *